United States Patent [19]

Henry

[11] Patent Number: 4,993,153

[45] Date of Patent: Feb. 19, 1991

[54] MULTIPLE BLADE STAND UP RAZOR

[76] Inventor: James G. Henry, 9881 N. W. 6th Crt., Plantation, Fla. 33324

[21] Appl. No.: 428,509

[22] Filed: Oct. 27, 1989

[51] Int. Cl.[5] ..... B26B 21/00; B26B 21/06; B26B 21/14

[52] U.S. Cl. ..... 30/50; 30/49; 30/32

[58] Field of Search ..... 30/32, 42, 49, 299, 30/50, 346.57, 346.58, 346.59, 85

[56] References Cited

U.S. PATENT DOCUMENTS

| | | | |
|---|---|---|---|
| 2,036,057 | 3/1936 | Kulisek | 30/50 |
| 2,048,419 | 7/1936 | Wolfe | 30/50 |
| 4,285,124 | 8/1981 | Diakonov | 30/32 |
| 4,534,110 | 8/1985 | Glass | 30/50 |

FOREIGN PATENT DOCUMENTS

| | | | |
|---|---|---|---|
| 895717 | 11/1953 | Fed. Rep. of Germany | 30/49 |
| 360988 | 11/1931 | United Kingdom | 30/49 |

*Primary Examiner*—Douglas D. Watts
*Assistant Examiner*—Paul M. Heyrana, Sr.
*Attorney, Agent, or Firm*—Malin, Haley, McHale, DiMaggio & Crosby

[57] ABSTRACT

A multiple blade razor in which a plurality of blades are positioned functionally perpendicular to radials extending away from the longitudinal center of a handle such that as a particular blade or set of blades becomes dull, the handle can be rotated around its longitudinal axis allowing the user to select a previously non-functionally a new blade or set of blades. Additionally, the handle of such a multiple blade razor includes a stable base of sufficient size and shape allowing the razor to be placed in a standing or upright position.

4 Claims, 1 Drawing Sheet

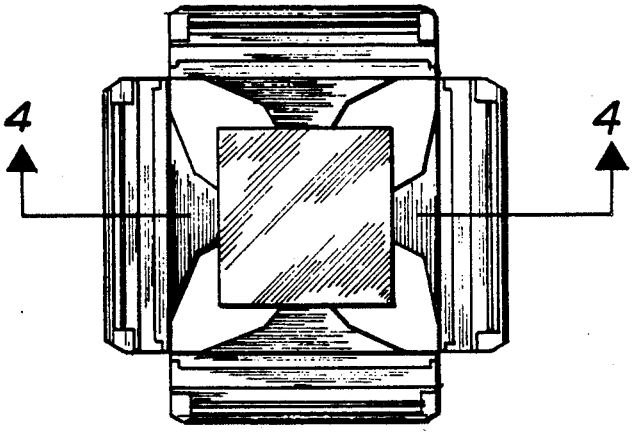
FIG. 1
FIG. 2
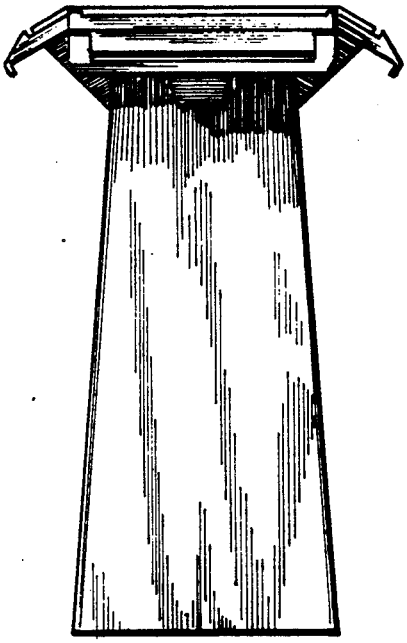
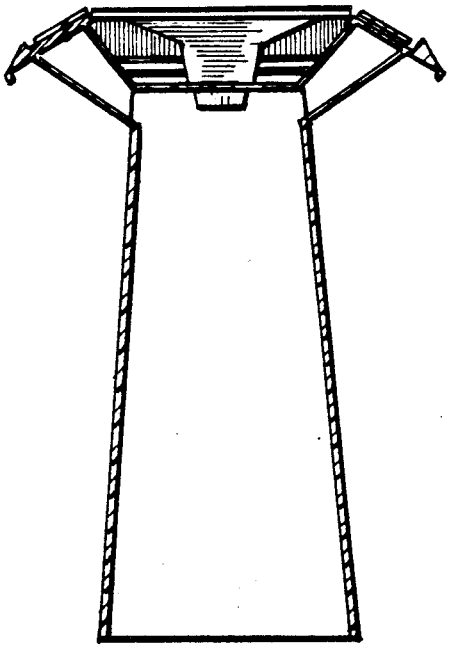
FIG. 4
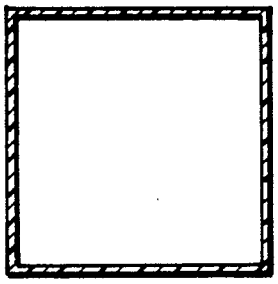
FIG. 3

MULTIPLE BLADE STAND UP RAZOR

FIELD OF THE INVENTION

This device relates to razors and more particularly to multiple bladed razors that can "stand up" on their base.

DESCRIPTION OF RELATED ART

Razors and razor devices are a common part of modern life. As an inspection of a supermarket or drug store will reveal, there exists a number of devices ranging from the old "straight razor" to single edged "safety razors" to "double-edged disposable razors". Despite the variety in types of razors and numbers of functional blades, two problems exist. First, the available razors do not contain multiple blades or sets of blades on the device itself so that when one blade or set of blades becomes dull, a new blade or set of blades can instantly and easily be placed into position for use. Secondly, the available razors and razor devices do not possess means for holding the razor in an upright or standing position so that it can be easily grasped and the blades held above the counter or sink area and thus removed from moisture and dulling contact with the counter or sink.

SUMMARY OF THE INVENTION

This invention is a razor that has multiple blades on the device itself, easily and readily positionable so as to be usable, and a base that allows the razor to "stand up" on the sink or counter to protect the razor from deterioration and dulling of the blades.

In view of the problems present with the prior art razor devices, it is an object of this invention to provide a razor device having multiple blades or sets of blades inherently available for use, without the necessity of replacing worn blades with new ones.

It is also highly desirable to provide a razor device which positions itself in an upright or standing position such that it can be easily grasped and withstand deterioration by being held above the counter top or sink area.

It is also highly desirable to provide a razor device which is structurally and operationally efficient, yet cost effective.

Finally, it is highly desirable to provide a razor device incorporating all the above mentioned features.

BRIEF DESCRIPTION OF DRAWINGS

FIG. 1 is a top view of one embodiment of the razor device.

FIG. 2 is a side view of one embodiment of the razor device showing the razor in a standing position.

FIG. 3 is a cross-sectional view of the base of the razor device showing the hollow nature of one embodiment.

FIG. 4 is a cross-section view of the device shown in FIG. 1 illustrating the arrangement of the blades and their connection to the handle, and the hollow nature of one embodiment of the razor device.

DETAILED DESCRIPTION OF THE PREFERRED EMBODIMENT

Referring now to the drawings, and more specifically to FIGS. 1 and 2, there is shown a standing razor 10 which comprises the preferred embodiment of the present invention. The razor 10 includes razor blades 12, a handle 14, attachment means 16 for attaching said razor blades 12 to said handle 14, and a base 40. The blades 12 can be of any conventional type, including either single blades or the double-edged type.

As seen in FIGS. 1 and 2, the razor device 10, in an alternative embodiment has four razor blades 12 attached to the handle 14 by the attachment means 16, so that the blades are facing away from the handle perpendicular to radials extending from the longitudinal center of the handle 14, so they are functionally positioned with respect to the handle 14. The blades 12 can be either permanently attached to the attachment means 16 or can be removable and replaceable by sliding the blades 12 onto a protrusion from the attachment means 16 via a slot on the blade assembly 18 as is common with interchangeable disposable blades. Although the preferred embodiment includes four razor blades 12, this invention contemplates use with as few as two razor blades and with as many razor blades as can be practically positioned around the handle 14 on radial lines extending away from the longitudinal center of the handle 14.

FIG. 2 shows the relationship between the blades 12, the attachment means 16, and the handle 14. In a preferred embodiment, the handle 14 has a square base 40, as shown in FIG. 3, with substantially flat sides extending from the base of the handle 14 to the attachment means 16 where the handle 14 melds into the attachment means 16. The sides 20, as well as the, attachment means 16, and blade assembly 18 of the device can be made of any rigid material such as plastic through processes common to the industry, including injection molding. As can be seen at 22, handle 14 in an alternative embodiment is hollow. Although the preferred embodiment of the invention includes a square base 40 and a handle 14 with substantially flat sides, any shaped base and any shaped handle can be incorporated into the invention so long as the base is flat and of sufficient size to provide a stable base when device 10 is in a "standing up" position, that is when the longitudinal center of the handle is perpendicular to the counter or other support upon which the base rests. It is also noted that whatever the shape of the handle 14, it must accommodate attachment means 16 by techniques which are common in the plastic manufacturing industry. Also, although the preferred embodiment includes a hollow handle 14 and attachment means 16, a solid handle and attachment means or a hollow handle and attachment means filled with some substance other than air is also within the spirit of the invention.

FIG. 4 shows a cross-sectional view of a preferred embodiment of the handle 14 and attachment means 16 showing the hollow nature of the device and the rigid nature of the sides 20.

The basic idea of the multiple blade aspect of the razor device is that a user will grasp razor 10 which is "standing up" on a counter or sink area. The user will grasp handle 14, and bring a particular blade 12 into physical contact with the user's face or other body area. After use for a sufficient amount of time, a particular blade 12 which has been in continuous use will become dull. When this happens, the user will rotate the stand up razor 10 about the longitudinal axis of the handle 10 so that an unused razor blade or set of blades 12 is now available for the user to bring into contact with his face or other area, thereby providing a new and/or sharp razor blade for this shave, or future ones. In this manner a single shaving device which inherently incorporates multiple razor blades is provided as an integral unit. The device could be used for a relatively long period of time until all of the various plurality of blades become dull. In an alternative embodiment the plurality of blades can then be replaced, and thereafter the device may once again be used for an extended period of time. Such a device has a particularly attractive utility with people who travel often whether related to business or pleasure.

While there have been described above the principals of this invention in connection with specific apparatus, it is to be clearly understood that this description is made only by way of example and not as a limitation to the scope of the invention.

What is claimed is:

1. A razor device, comprising:

(a) a handle including a base means, said base means being flat and of sufficient size to provide a stable base when the longitudinal center of said handle is perpendicular to the counter or other support on which said handle rests; said base means for supporting said razor device in a stable and upright position when placed upon a counter top, sink area, or other support surface;

(b) a plurality of razor blades protruding outwardly from said handle, said blades being generally perpendicular to radials extending from the longitudinal axis of said handle;

(c) means for integrally and non-removably attaching said razor blades to said handle wherein said razor blades are functionally positioned in relation to said handle such that rotation of said handle about its longitudinal axis rotates the previously functional razor blade to a non-functional position and simultaneously rotates a previously non-functional razor blade into a functional position.

2. The device of claim 1 wherein said handle and said base means comprise a generally hollow handle, said handle being tapered from a generally narrowed position at an interface with means for attaching said razor blades to a generally expanded configuration at said base means, thereby providing a structurally and functionally stable handle for said razor device.

3. A razor device, comprising:

(a) a handle including a base means, said base means being flat and of sufficient size to provide a stable base when the longitudinal center of said handle is perpendicular to the counter or other support on which said handle rests, said base means for supporting said razor device in a stable and upright position when placed upon a counter top, sink area, or other support surface;

(b) a plurality of razor blades protruding outwardly from said handle, said blades being generally perpendicular to radials extending from the longitudinal axis of said handle;

(c) means for slidingly attaching said razor blades to said handle wherein said razor blades are functionally positioned in relation to said handle such that rotation of said handle about its longitudinal axis rotates the previously functional razor blade to a non-functional position and simultaneously rotates a previously nonfunctional razor blade into a functional position.

4. The device of claim 3 wherein said handle and said base means comprise a generally hollow handle, said handle being tapered from a generally narrowed position at an interface with means for attaching said razor blades to a generally expanded configuration at said base means, thereby providing a structurally and functionally stable handle for said razor device.

* * * * *